United States Patent [19]

Cropper

[11] 4,013,316

[45] Mar. 22, 1977

[54] MECHANICAL STOOL FOR HANDICAPPED PERSONS

[76] Inventor: Winifred Cropper, 100 Central Ave., Rochelle Park, N.J. 07662

[22] Filed: Jan. 21, 1975

[21] Appl. No.: 542,825

[52] U.S. Cl. ..... 297/347; 4/185 S

[51] Int. Cl.[2] ..... A47K 3/12; A47C 15/00

[58] Field of Search ..... 297/347, 461, 339; 248/404, 400; 108/147; 4/185 S, 185 L; 5/63

[56] References Cited

UNITED STATES PATENTS

| | | | |
|---|---|---|---|
| 1,982,245 | 11/1934 | Feulner | 4/185 L |
| 2,352,678 | 7/1944 | Angell | 248/404 |
| 2,552,693 | 5/1951 | Smith | 297/461 |
| 2,691,404 | 10/1954 | Saunders | 4/185 L |
| 2,697,475 | 12/1954 | Dueth | 297/347 X |
| 2,725,578 | 12/1955 | Keller | 4/185 L |
| 3,311,933 | 4/1967 | Peterson | 5/63 X |
| 3,435,466 | 4/1969 | Cheney | 4/185 L |
| 3,438,675 | 4/1969 | Seguin et al. | 297/461 |
| 3,479,087 | 11/1969 | Burke | 297/339 |

*Primary Examiner*—James T. McCall
*Attorney, Agent, or Firm*—Stefan M. Stein

[57] ABSTRACT

A stool intended for use by handicapped persons while bathing, gardening, and the like including a horizontally disposed non-skid base having a telescopically adjustable vertically disposed support mast affixed thereto and extending vertically upwardly therefrom to have a horizontally positioned seat mounted thereon, an air operated hydraulic means disposed inwardly of the mast and connected by suitable tubing to an electrically operated air compressor having control means associated therewith and adapted to be energized by a suitable source of electrical energy with the control means effecting the extension and retraction of the mast for raising and lowering the seat relative to the base.

1 Claim, 2 Drawing Figures

MECHANICAL STOOL FOR HANDICAPPED PERSONS

BACKGROUND OF THE INVENTION

1. Field of the Invention

This invention relates to an elevating and lowering stool intended for use by handicapped persons in a manner enabling the handicapped person when occupying the stool to raise or lower themselves.

2. Description of the Prior Art

It is well known that elderly or disabled persons perform ordinary tasks only with a great deal of difficulty, with such tasks including those of bathing, gardening, and the like. One area of difficulty is that of the individual lowering themselves to a seated position along with raising themselves from the seated position, such as required while bathing, gardening, and the like.

SUMMARY OF THE INVENTION

The present invention recognizes the difficulty of a handicapped person to raise and lower themselves and provides a novel solution thereto in the form of a powered stool readily adjustable in vertical height between an elevated and lowered position by the handicapped individual while occupying the stool.

Among the advantages of the present invention is the provision of a mechanical stool for handicapped persons which is relatively simple in its construction and which therefore may be readily manufactured at a relatively low cost and by readily available manufacturing methods; one which is easy to use and reliable and efficient in operation; and one which is aesthetically pleasing and refined in appearance.

Other advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
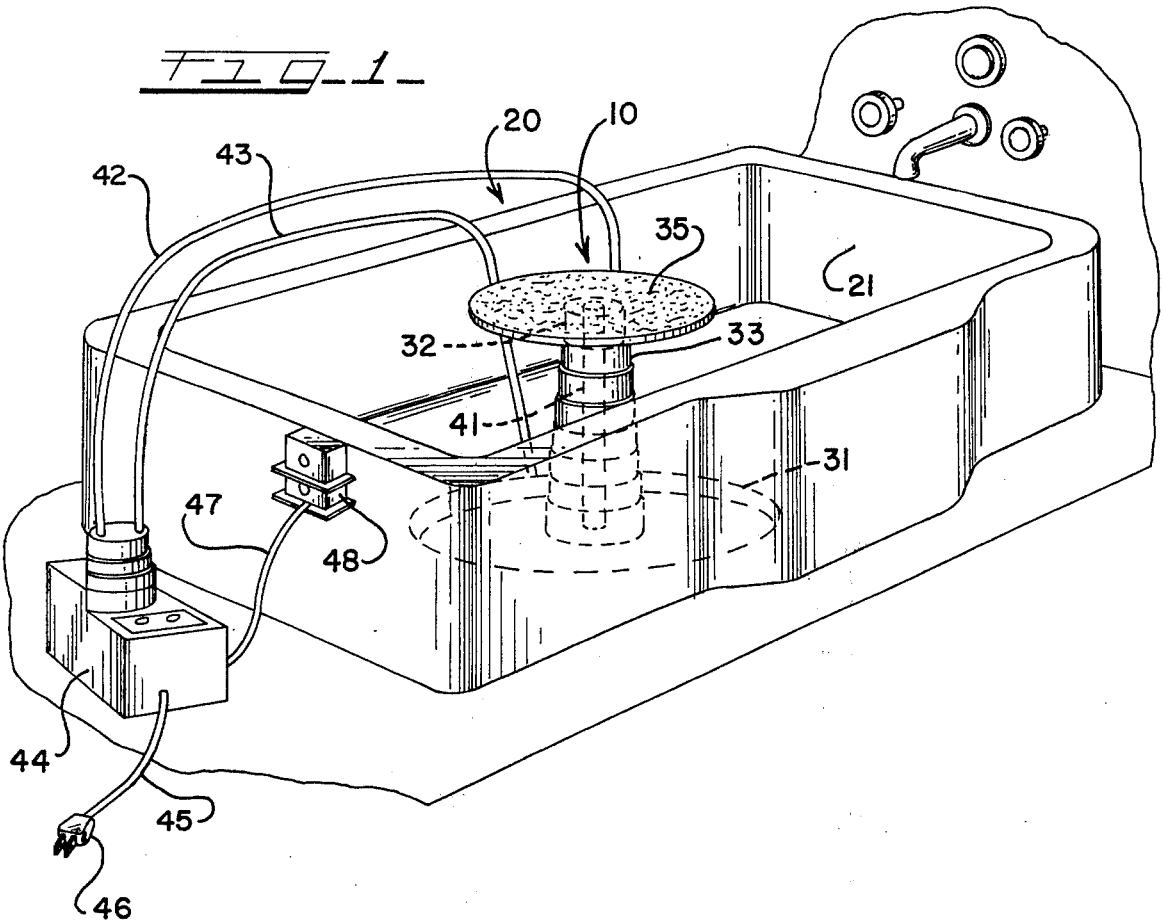
FIG. 1 is a perspective view of the mechanical stool of the present invention illustrated in use with a conventional type of bathtub.
Figure 2:
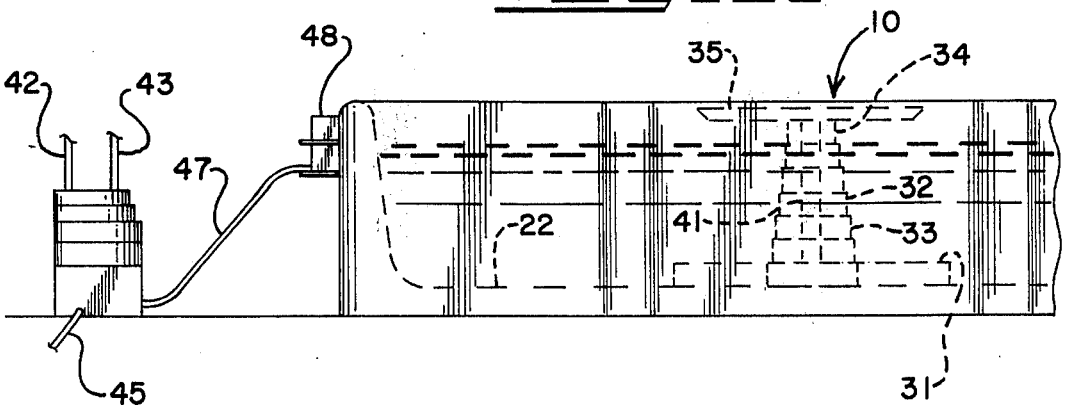
FIG. 2 is a fragmentary side elevational view of the stool in the bathtub as seen in FIG. 1.

Referring now to the drawings in detail there is illustrated a preferred form of a stool embodying the invention and which is designated in its entirety by the reference numeral 10 and which, for purposes of illustration, is illustrated as used in a conventional bathtub 20 having bathing compartment 21 with a bottom surface 22.

The stool 10 is formed of a flat disc shaped base member 31 manufactured of a non-skid material, at least along its bottom surface, adapted to rest on bottom surface 22 of tub 20. A mast 32 of a telescopic structure formed by cylindrical collar like members 33 has its bottom collar member affixed concentric of the top surface of base 31 with the mast extending vertically upwardly therefrom and terminating in a top collar member having a flat top surface 34. Collar members 33 each have a hollow interior with the collar members disposed in a general pyramidal fashion for telescoping relationship relative to each other between a maximum extended position and a maximum retracted position.

Affixed concentric to the top surface 34 of topmost collar member 33 is a disc shaped seat member 35 which is preferably covered by a foam rubber pad and a durable covering, such as vinyl, leather, or some other synthetic fabric.

Disposed inwardly of collar members 33 and extending axially therethrough is an air actuated piston and cylinder member 41 having its top end connected to seat 35 with its bottom end connected to base 31. The inlet and outlet ports of the piston and cylinder member 41 are connected by means of suitable flexible hosing 42 and 43 to control means including an electrically operated air compressor 44 provided with an electrical cord 45 terminating in plug 46 adapted to be plugged into a suitable source of household electrical energy and a control member 48. Electrical wiring 47 extends from air compressor 44 to the control member 48 adapted to be mounted on an exterior surface of the tub 20 in a position readily reachable by an individual seated on seat 35 for control of the stool 10.

In operation, seat 35 is elevated by piston and cylindrical member 41 to its maximum vertical height spaced from base 31 for an individual to easily sit thereon, after which the individual by means of control 48 effects the lowering of seat 35 to the desired height for bathing. After bathing, the individual again uses control 48 to effect the elevation of seat 35 for ease in rising from the seat to leave the tub 20.

It is to be understood that the form of this invention herewith shown and described is to be taken as a preferred example of the same, and that this invention is not to be limited to the exact arrangement of parts shown in the drawings or described in this specification as various changes therein are envisioned without departing from the spirit or scope of the invention or of the following claims.

What I claim is:

1. A portable stool intended for use by handicapped persons and the like, comprising, in combination:

a non-slip base member having a substantially flat disc configuration including a top surface and a bottom surface, said bottom surface of said base member removably engaging a bathing compartment;

a seat member having a substantially disc shape including a top surface and a bottom surface;

a telescopic support mast having one end affixed to said top surface of said base member with the opposite end of said telescopic support mast affixed to said bottom surface of said seat member with said seat member disposed vertically above and concentric with said base member, said telescopic support mast comprising a series of concentrically disposed different diameter hollow collar members of cylindrical configuration, said collar members being nested within each other when said seat member is disposed adjacent said base member which corresponds to said mast being in a maximum retracted position, said collar members being telescoped outwardly to place said seat member spaced furthest away from said base member when said mast is in a maximum extended position;

power means disposed inwardly of said support mast comprising an air operated piston and cylinder member with said piston being affixed to said seat member and with said cylinder being affixed to said base member;

control means connected to said power means for controlling power air pressure into said piston and cylinder member to effect extension and retraction of said mast;

said control means being connected to said power means by flexible hose means for facilitating removal of the stool from the bathing compartment; and said base member and said seat member being cooperatively disc-shaped to provide a substantially flat disc-shaped compact structure when said telescoping supporting mast is in its fully retracted position enabling the bather to fully recline within the bathing compartment while the stool is disposed on the floor of the bathing compartment.

* * * * *